US006845880B2

(12) United States Patent
Charmasson et al.

(10) Patent No.: US 6,845,880 B2
(45) Date of Patent: Jan. 25, 2005

(54) DISPENSING CONTAINER FOR SYMMETRICAL ARTICLES

(76) Inventors: Henri J. A. Charmasson, 2030 Sunset Blvd., San Diego, CA (US) 92103; John D. Buchaca, 4646 Judson Way, La Mesa, CA (US) 91941

( * ) Notice: Subject to any disclaimer, the term of this patent is extended or adjusted under 35 U.S.C. 154(b) by 43 days.

(21) Appl. No.: 10/243,424

(22) Filed: Sep. 13, 2002

(65) Prior Publication Data

US 2004/0050856 A1 Mar. 18, 2004

(51) Int. Cl.[7] ..... B65G 59/00
(52) U.S. Cl. ..... 221/107; 221/295
(58) Field of Search ..... 221/109, 107, 221/295, 67, 111, 103, 197, 150, 153, 104, 105; 312/42, 45, 72

(56) References Cited

U.S. PATENT DOCUMENTS 2,770,393 A * 11/1956 Gale ..... 221/107
2,877,928 A * 3/1959 Patzer et al. ..... 221/295
3,467,275 A * 9/1969 Barton et al. ..... 221/197

* cited by examiner

*Primary Examiner*—Kenneth Noland
(74) *Attorney, Agent, or Firm*—Henri J. A. Charmasson; John D. Buchaca

(57) ABSTRACT

A container for holding and dispensing articles such as beverage cans and bottles wherein a first set of said articles are laid horizontally in a row over a slanted floor, and are retained therein by a vertically movable plate resting upon said row. A barrier projects downwardly from the front edge of the plate against the lowermost article in the first set and prevents the entire set from rolling toward an opening at the base of the slanted floor. A second set of articles is similarly positioned upon the plate. The weight of the second set prevents the plate and barrier from moving upward and freeing the first set until all the articles in the first set have rolled toward the opening. Additional plates and sets of articles can be superimposed above the first and second sets. A control gate is provided to allow the articles to be dispensed one by one through the opening.

13 Claims, 2 Drawing Sheets

FIG. 2
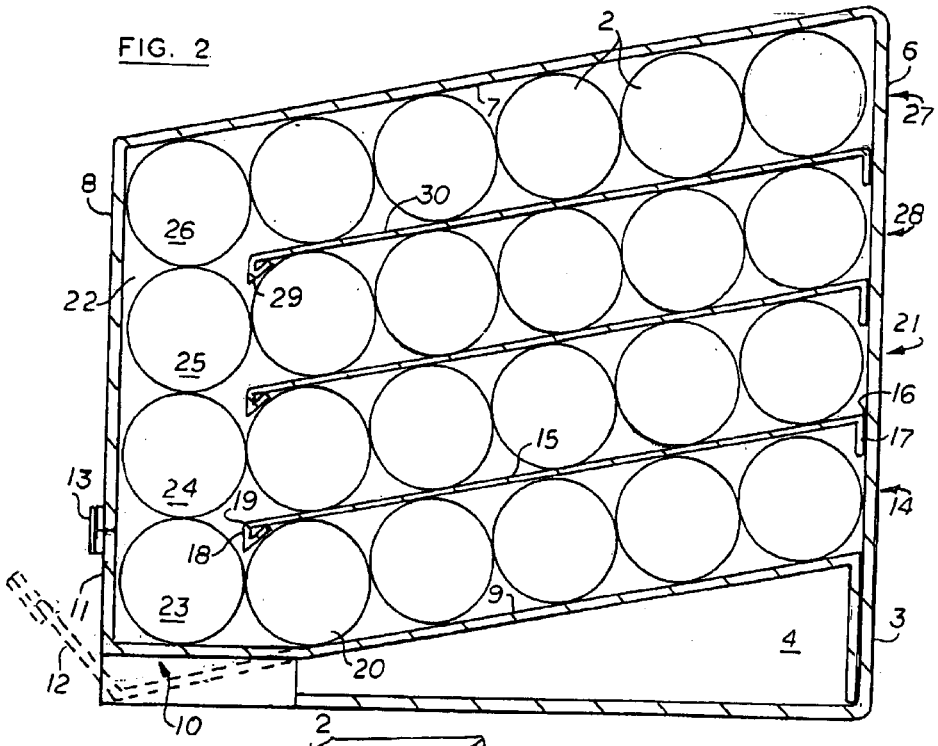
FIG. 1
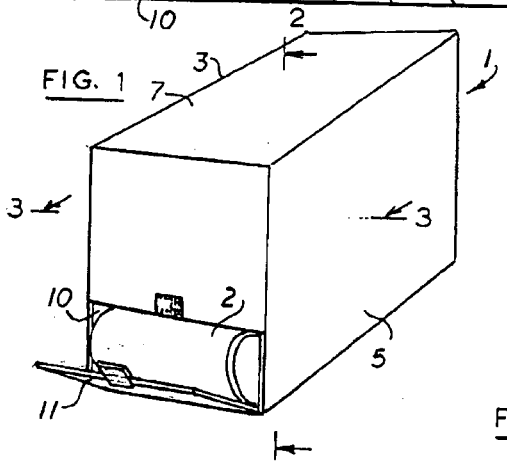
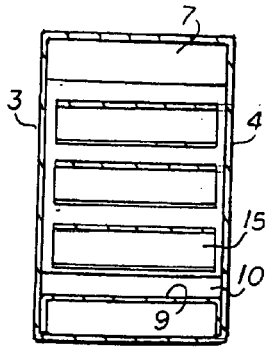
FIG. 3

DISPENSING CONTAINER FOR SYMMETRICAL ARTICLES

FIELD OF THE INVENTION

This invention relates to the packaging of consumer articles and more particularly beverage cans and bottles and to automatic dispensers for those articles.

BACKGROUND OF THE INVENTION

Soda cans and other beverage containers are commonly sold in six, twelve or twenty-four pack configurations. The cans are either held together by a plastic retainer of enclosed into a cardboard box. The customer must rip the box apart or separate each can from its plastic retainer before placing them into a refrigerator. The procedure is time-consuming and the cans occupy a great amount of space on a refrigerator shelf once they are placed there in an upright position.

Automatic vending machines for sodas are typically refilled from twenty-four pack boxes in which they are transported to the machine site. The box must be ripped apart and the cans fed one-by-one into the vending machine mechanism.

U.S. Pat. No. 6,330,958 Ruskin et al. discloses a vending machine that accepts substitutable magazines capable of holding up to thirty-two cans or bottles. The magazines are filled at a central location, brought to the vending machine site, and installed into the machine after the previously installed empty or partially empty magazine has been removed. The capacity of the magazine is limited by its weight. Thirty-two soda cans, each containing 355 milliliters (12 fluid ounces) of liquid weigh about 11.4 kilos (25 pounds). When added to the weight of the magazine itself, they create a load that may exceed the maximum lifting weight imposed by labor and safety regulations. Currently substitutable magazines are limited to a twenty-four-can configuration. Due to this limited capacity, the substitutable magazine concept has only been applied to small counter-top vending machines, and, to this day, it has found no use in large vending machines capable of storing up to six hundred cans or bottles.

This invention results from attempts to provide a more practical and efficient way of packaging symmetrical articles, and to provide a more efficient way to load articles in vending machines.

SUMMARY OF THE INVENTION

The principal object of this invention is to provide a package capable of holding a large number of symmetrically configured or packaged items that can be conveniently dispensed from a small opening without having to rip the package apart or separate the items from other types of restraining structure.

Another object of this invention is to provide such a package in a configuration that can be installed into an automatic vending machine instead of loading the items one at a time.

These and other valuable objects are achieved by packaging a number of cans, bottles or similarly configured articles into a four-cornered box made of cardboard or other light laminar material. The internal width of the box corresponds to the height of the articles. The articles are laid therein in a horizontal position, axially parallel and contiguous to one another. At the bottom of the box, a ramp orthogonal to the lateral walls, runs downwardly from the back wall of the box toward and opening about the junction of the front wall and the bottom of the box. Each lateral wall has a back edge permanently attached to the back wall of the box, and a front edge permanently attached to the front wall. A number of articles are arranged in a first row movingly supported by the upper surface of the ramp. Depending upon their shape, free of restraint, the articles can either roll or slide down the ramp under the pull of gravity. A first plate is laid upon the first row of articles and is restrained from sliding forwardly by some form of attachment to the side wall or to the back wall of the box. However, the front end of the plate is allowed to move upwardly if pushed from underneath. A barrier is formed at the front end of the plate and projects downwardly against the lowermost article in the first row to prevent it and all the other following articles in the row from sliding down the ramp. The plate can be restrained by having its back end hingedly connected to the back wall by a nib projecting from a lateral edge of the plate into a vertical groove cut into one of the lateral walls, or any of the mechanical arrangements that allows vertical movement of the front end of the plate and the barrier.

The space between the first row as well as the front end of the plate and the front wall of the box is occupied by one article positioned proximately or above the opening of the box. That opening forms an exit port and is preferably closed by a releasable flap or gate of some kind.

A second row of articles is positioned on top of the plate and another article is stacked on top of the one proximate or above the opening so that the second row is prevented from sliding down the plate once the lowermost article in the second row contacts the aforesaid article. The weight of the articles in the second row bearing upon the plate keeps the barrier against the front edge of the lowermost article in the first row so that the first row of articles will not begin to move down the ramp until all articles in the second row have slid down the plate following the exit of all other articles in the box. At that point, the pressure exerted by the weight of the first row of articles against the barrier forces it and the plate upward, releasing the first row. The back edge of the barrier is preferably shaped to provide a good sliding contact with the front edge of the lowermost article in the first row. If the article happens to be a cylindrical container, then the back edge of the barrier is preferably an oblique surface that provides a good sliding contact with the rounded top of the container.

Accordingly, if the flap or gate across the opening is withdrawn, the article will start exiting the box under their own weight, beginning with the two articles immediately behind the front wall followed by the second row and finally the first row. Additional plates and rows of articles can be superimposed over the second row. Moreover, an opening can be practiced in the top of the box near the front wall so that an additional box may be mounted on top of the first one with the opening at the base of the ramp in the top box matching the opening in the top of the first box. This latest configuration can be adapted to the loading of articles in a vending machine.

BRIEF DESCRIPTION OF THE DRAWING

FIG. 1 is a front perspective view of a dispensing container according to the invention;

FIG. 2 is a cross-sectional view taken along line 2—2 of FIG. 1;

FIG. 3 is a back cross-sectional view taken along 3—3 of FIG. 1 without the cans;

DESCRIPTION OF THE PREFERRED EMBODIMENT OF THE INVENTION

Figure 4:
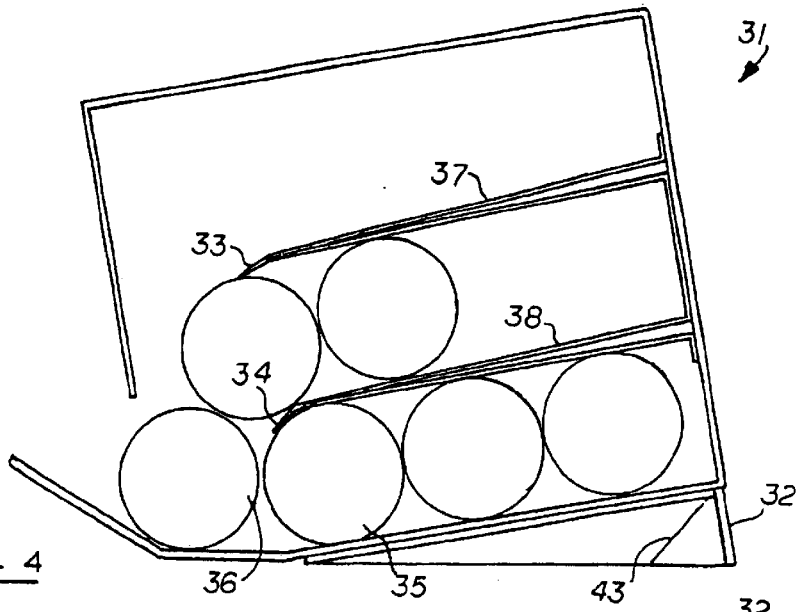
FIG. 4 is a cross-sectional view of an alternate embodiment of the invention.

Referring now to the drawing, there is shown a container 1 for holding and dispensing up to 24 beverage cans 2 such as those commonly used for packaging sodas and other beverages. The container comprises a four-cornered box 3 preferably made of cardboard or laminated plastic material. The enclosure has a right side wall 4, a left side wall 5, a back wall 6, a top cover 7 and a front wall 8. A slanted floor 9 in a lower area of the enclosure forms a ramp extending downwardly from the back wall 6 toward an opening acting as an exit port 10 at the lower front corner of the enclosure. In this embodiment of the invention, the exit port is sealed by a flap 11 forming the lower front corner of the enclosure. A semi-open position of the flap 12 is shown in dotted line on the drawing. In that semi-open position of the flap, cans can be picked up one by one as each one rolls upon the flap. A fastener 13 at the edge of the flap provides a means for securing it in a closed position. The fastener is formed by cooperating patches of hook-and-loop fabric. Other types of latch can be substituted for the fabric fastener 13. In a first row 14, a number of articles are movably supported by the ramp 9 in a lower region of the box. A flat plate 15 rests upon the first row of cans. The back end 16 of the plate is hingedly secured to the back wall. Preferably, the back, flanged ledge 17 of the plate is glued to the inside surface of the back wall. Accordingly, the plate can move upwardly, but is prevented from sliding down toward the front wall. A barrier 18 in the form of a wedge-shaped bar is formed on the under surface of the plate and along its front end 19. The barrier projects downwardly against the lowermost can 20 preventing it, and all the other cans in the row, from moving toward the exit port 10. The plate 15 is maintained into it locking position by the weight of a second set or row 21 of cans resting upon it. Two additional plates and rows of cans are further superimposed above the first and second rows. The front wall 8 is spaced apart from the front end 18 of the plates by a distance slightly larger than the diameter of a can to form a chute 22 into which are stacked on top of one another, four or more cans 23–26 each of which being substantially in line with one of the four rows of cans.

It can now be understood that upon opening of the exit port 10, the lowermost can 23 in the chute will be the first one to exit the enclosure followed by the remaining cans 24–26 in the chute. Next, the uppermost row 27 of cans will follow down the chute. At that point, gravity will cause the second highest row 28 to bear against the barrier 29 of the uppermost plate 30 causing the plate that is no longer weighted down by the uppermost row 27, to move upwardly, freeing the second uppermost row of cans 28 to fall down the chute. The same operation repeats itself from row to row until the lowermost row riding upon the ramp 9 is allowed to escape the box. The sequential releasing movement of the plates as they pivot slightly upward, provide for an orderly dispensing of the cans one at a time through the exit port 10.

For cylindrical articles such as beverage cans or bottles that are laid horizontally and contiguously in axially parallel arrangement so that they can easily roll down the ramp 9 as illustrated in the drawing, the pitch of the ramp can be set within a range of approximately 5 to 10 degrees. For non-cylindrical articles such as trays of frozen food, or items packaged in quadrangular boxes that must slide rather than roll down the ramp, the pitch may be substantially higher in order to provide a smooth progress of the items down the plates and ramp under the pull of gravity.

The dispensing container can be made in a variety of configurations and sizes to accommodate any number of articles. In a 12 or 24 pack configuration, the container can conveniently be used to package beverages. Once placed on a refrigerator shelf, the user can open the flap or other cover sealing the exit port and extract the beverage containers one by one as needed without having to rip apart the enclosure or freeing the can from plastic straps and other restraining devices commonly used in the trade.

The dispensing container can also be part of an automatic vending machine of the type disclosed in U.S. Pat. No. 6,367,653 Ruskin et al. This patent is incorporated in this specification by this reference. When used as part of an automatic vending machine, the dispensing container can be coupled with any one of the dispensing mechanisms disclosed in the referenced patent. Several containers can be stacked and made to feed into the lower ones.

Figure 5:
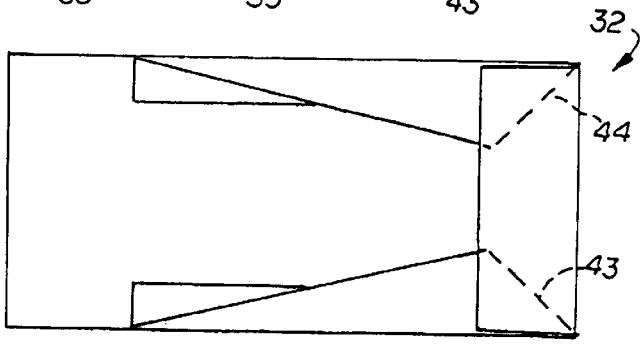
FIG. 5 is a bottom plan view of the collapsed support wedge.
Figure 6:
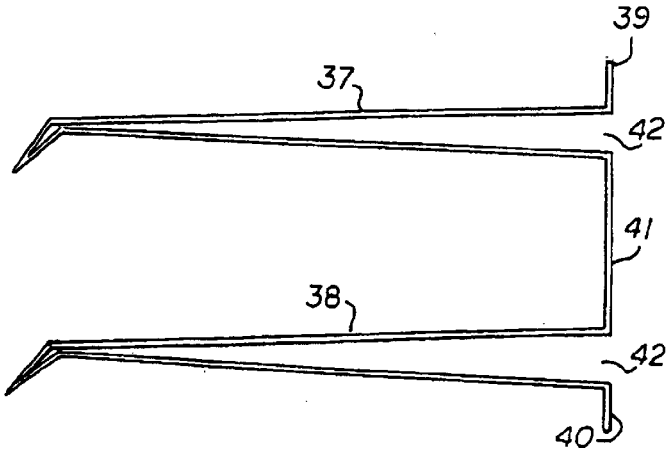
FIG. 6 is a side view of the plates.

The alternate embodiment of the invention illustrated in FIGS. 4, 5 and 6 consist of a container 31 for twelve soda cans based on the general principle of the one previously disclosed in connection with twenty-four soda cans, but which features a folding wedge-support 32 affixed to the underside surface of the container. Accordingly, in its shipping configuration, the container appears like a regular six-pack having orthogonal walls. In addition, the barriers 33, 34 at the lower end of the plates separating the rows of cans do not consist of rigid wedges but are flaps hingedly secured to the front end of the plates.

As shown in FIG. 4, where some of the cans have already exited the container, each flap which is normally inserted between the lowermost can in a row 35 and the adjacent one 36 in the chute, flips upwardly as shown in connection with the second row of cans as soon as there is no more any cans immediately in front if it in the chute. As more specifically illustrated in FIG. 6, the plates 37, 38 are formed from a single strip of cardboard appropriately folded in the illustrated shape. The ends 39, 40 and the medium portion 41 of the strip is glued to the back wall of the container leaving a small gap 42 between the two layers forming the plate and flap in order to provide some added rigidity to the plate.

It should be noted that in some applications the plate need not be secured to the backwall. The pressure of the can located in the chute against the flap is sufficient to keep the plate stationary.

The folding of the supporting wedge 32 occurs along crease lines 43 and 44 imparted to the structure.

Such a container can be shipped, stored, and carried away by the customer in its folded configuration, then propped up by the unfolding of the wedge 32 before being installed on a refrigerator shelf in order to assure an orderly an flowing dispensing of the cans.

While the preferred embodiments of the invention have been described, modifications can be made and other embodiments may be devised without departing from the spirit of the invention and the scope of the appended claims.

What is claimed is:

1. The combination of a set of solid articles and their dispensing container, said combination comprising:

a four-cornered enclosure including two opposite side walls, a front wall, a back wall and a top cover;

each of said walls having a front edge connected to said front wall and a back edge connected to said back wall;

a ramp parallel to, and held between said side walls in a lower region of said enclosure;

said ramp being oriented downwardly from said back edges toward said front edges;

said ramp having a lower forefront;

a number of said articles being contiguously disposed side-by-side on said ramp in a first row between said back wall and a lower area of said ramp;

an exit port located proximate said forefront and being shaped and dimensioned to allow passage of one of said articles;

a substantially flat plate having a front end, a back end, a top surface and a bottom surface, said plate being shaped and dimensioned to extend over said number of articles;

a barrier secured to the bottom face of said plate proximate said front end, comprising a fixed wedge-shaped bar, said barrier being shaped and dimensioned to prevent said number of articles from moving on said ramp toward said exit port;

a second row of articles resting above the top surface of said plate;

a first article positioned between the forefront of said ramp and said exit port; and a second article laying above said first article and between said barrier and said front wall;

whereby upon opening of said exit port, said articles exit said enclosure in an orderly sequence.

2. The combination of claim 1, wherein said articles are cylindrically shaped and are laid horizontally and axially parallel to one another.

3. The combination of a set of solid articles and their dispensing container, said combination comprising:

a four-cornered enclosure including two opposite side walls, a front wall, a back wall and a top cover;

each of said walls having a front edge connected to said front wall and a back edge connected to said back wall;

a ramp parallel to, and held between said side walls in a lower region of said enclosure;

said ramp being oriented downwardly from said back edges toward said front edges;

said ramp having a lower forefront;

a number of said articles being contiguously disposed side-by-side on said ramp in a first row between said back wall and a lower area of said ramp;

an exit port located proximate said forefront and being shaped and dimensioned to allow passage of one of said articles;

a substantially flat plate having a front end, a back end, a top surface and a bottom surface, said plate being shaped and dimensioned to extend over said number of articles;

a barrier secured to the bottom face of said plate proximate said front end, comprising a flap hingedly secured to said plate, said barrier being shaped and dimensioned to prevent said number of articles from moving on said ramp toward said exit port;

a second row of articles resting above the top surface of said plate;

a first article positioned between the forefront of said ramp and said exit port; and a second article laying above said first article and between said barrier and said front wall;

whereby upon opening of said exit port, said articles exit said enclosure in an orderly sequence.

4. The combination of a set of solid articles and their dispensing container, said combination comprising:

a four-cornered enclosure including two opposite side walls, a front wall, a back wall and a top cover;

each of said side walls having a front edge connected to said front wall and a back edge connected to said back wall;

a ramp parallel to, and held between said side walls in a lower region of said enclosure;

said ramp being oriented downwardly from said back edges toward said front edges;

said ramp having a lower forefront;

a number of said articles being contiguously disposed side-by-side on said ramp in a first row between said back wall and a lower area of said ramp;

an exit port located proximate said forefront and being shaped and dimensioned to allow passage of one of said articles;

a substantially flat plate having a front end, a back end, a top surface and a bottom surface, said plate being shaped and dimensioned to extend over said number of articles;

a barrier secured to the bottom face of said plate proximate said front end, said barrier being shaped and dimensioned to prevent said number of articles from moving on said ramp toward said exit port;

a second row of articles resting above the top surface of said plate;

a first article positioned between the forefront of said ramp and said exit port; and a second article laying above said first article and between said barrier and said front wall;

whereby upon opening of said exit port, said articles exit said enclosure in an orderly sequence; and a wedge-shaped, foldable support affixed to a bottom surface of said enclosure.

5. A dispensing container for a plurality of articles which comprises:

a fixed, slanted floor shaped and dimensioned to movingly support a number of said articles;

a vertically movable plate laying over said number of articles; and retaining means for said number of articles secured to a frontal section of said plate;

wherein said retaining means comprise a rigid wedge-shaped bar fixedly secured to a frontal area of said plate;

whereby the weight of at least one article positioned over said plate or retaining means will hold said retaining means against a lower one of said number of articles impeding their movement down said slanted floor.

6. A dispensing container for a plurality of articles which comprises:

a fixed, slanted floor shaped and dimensioned to movingly support a number of said articles;

a vertically movable plate laying over said number of articles; and retaining means for said number of articles secured to a frontal section of said plate;

wherein said retaining means comprise a flap hingedly attached to a frontal area of said plate;

whereby the weight of at least one article positioned over said plate or retaining means will hold said retaining means against a lower one of said number of articles impeding their movement down said slanted floor.

7. The container of claim 6 which further comprises a box enclosure mounting said floor and having an exit port proximate a lower portion of said floor.

8. The combination of the dispenser of claim 7 with a plurality of symmetrical ones of said articles wherein said articles are cylindrically shaped and are laid horizontally and axially parallel to one another, a first set of said articles resting against said floor and a second set of said articles resting upon said plate.

9. The combination of claim 8 which further comprises a first of said articles positioned between said first set and said exit port and a second of said article positioned above said first article adjacent said second set.

10. The combination of claim 6 which further comprises means for controlling the dispensing of said articles one-by-one out of said exit port.

11. The combination of claim 10, wherein said means for controlling comprises a gate for releasably closing said opening.

12. The combination of claim 11, wherein said gate is automatically driven by an electro-mechanical control mechanism.

13. A dispensing container for a plurality of articles which comprises:

a fixed, slanted floor shaped and dimensioned to movingly support a number of said articles;

a vertically movable plate laying over said number of articles; and retaining means for said number of articles secured to a frontal section of said plate;

whereby the weight of at least one article positioned over said plate or retaining means will hold said retaining means against a lower one of said number of articles impeding their movement down said slanted floor; and a wedge-shaped, foldable support secured to a bottom surface of said container.

* * * * *